US010914466B2

(12) United States Patent
Nadtochey et al.

(10) Patent No.: US 10,914,466 B2
(45) Date of Patent: Feb. 9, 2021

(54) METHOD FOR OPERATING A HEATING BOILER AND HEATING BOILER FOR CARRYING OUT SAID METHOD (VARIANTS)

(71) Applicant: Eduard Petrovich Gayzer, Novosibirsk (RU)

(72) Inventors: Mikhail Aleksandrovich Nadtochey, Novosibirsk (RU); Aleksandr Anatol'evich Zaytsev, s. Ivanicheskoe (RU)

( * ) Notice: Subject to any disclaimer, the term of this patent is extended or adjusted under 35 U.S.C. 154(b) by 112 days.

(21) Appl. No.: 15/762,923

(22) PCT Filed: Sep. 28, 2015

(86) PCT No.: PCT/RU2015/000616
§ 371 (c)(1),
(2) Date: Mar. 23, 2018

(87) PCT Pub. No.: WO2017/058041
PCT Pub. Date: Apr. 6, 2017

(65) Prior Publication Data

US 2018/0283681 A1 Oct. 4, 2018

(51) Int. Cl.

| | |
|---|---|
| ***F01K 7/40*** | (2006.01) |
| ***F22B 1/18*** | (2006.01) |
| ***F22B 9/18*** | (2006.01) |
| ***F22B 37/34*** | (2006.01) |
| ***F22B 9/02*** | (2006.01) |

(52) U.S. Cl.
CPC ..... *F22B 1/1815* (2013.01); *F22B 9/02* (2013.01); *F22B 9/18* (2013.01); *F22B 37/34* (2013.01)

(58) Field of Classification Search
CPC . F01K 7/40; F01K 23/18; F01K 11/00; F02G 1/04
USPC ..... 122/7 R, 448.4, 459, 509, 446, 450
See application file for complete search history.

(56) References Cited

U.S. PATENT DOCUMENTS 2,825,314 A * 3/1958 Engel ..... F22G 5/16 122/382
3,412,558 A * 11/1968 Starmer ..... C02F 1/16 60/676
3,913,331 A * 10/1975 Conwell ..... F01K 17/02 60/692
4,462,339 A * 7/1984 Jahnke ..... F22B 1/1892 122/32
4,691,522 A * 9/1987 Brown, II ..... F01K 5/00 60/641.8

(Continued)

*Primary Examiner* — Gregory A Wilson

(57) ABSTRACT

A method for operating a heating boiler and variant embodiments thereof are proposed. A working fluid is heated in the heating boiler consisting of at least two chambers by the heat of at least one heat carrier, and, by means of at least one of the heat exchangers in the heating boiler, a change in the temperature of the heat carrier in relation to the working fluid in the chambers is realized by supplying a more greatly heated heat carrier to the chambers containing a more greatly heated working fluid and, correspondingly, supplying a less greatly heated heat carrier to the chambers containing a less greatly heated working fluid, and, after heating, the working fluid is conducted out of the chamber via at least one channel or valve for use. The technical result is an increase in the efficiency of the heat recovering.

20 Claims, 6 Drawing Sheets

(56) References Cited

U.S. PATENT DOCUMENTS

| | | | | | |
|---|---|---|---|---|---|
| 4,694,782 | A * | 9/1987 | Premel | F22B 1/1846 | 122/406.4 |
| 4,796,570 | A * | 1/1989 | Lameris | F22B 1/1884 | 122/7 R |
| 7,007,453 | B2 * | 3/2006 | Maisotsenko | F01K 21/047 | 415/178 |

* cited by examiner

METHOD FOR OPERATING A HEATING BOILER AND HEATING BOILER FOR CARRYING OUT SAID METHOD (VARIANTS)

CROSS-REFERENCE TO RELATED APPLICATIONS

The present patent application is a National stage application of the PCT application PCT/RU 2015/000616 filed Sep. 28, 2015.

FIELD OF INVENTION

The present invention relates to thermal power engineering, engine technology and is designated to be used in steam power plants and combined cycle gas turbine units, in vehicles' engine units, in external heated engines.

BACKGROUND

Modern heat engine efficiency does not exceed 50%. Heat recovery steam generators, converting exhaust gases energy into high pressure steam power, are known (Great Soviet Encyclopedia, V. 13, Moscow: "Soviet Encyclopedia", 1973, p. 285). Heat recovery steam generators are large-sized and steam energy needs further conversion.

The heat recovery steam generator, capable to recover high-temperature fuel gas heat, is known (patent RU 2406024, IPC F23C9/00, published on 20 May 2010). The fuel gas processing method consists in burning in a boiler a part of the fuel gas from the gas turbine, taken at the inlet into the heat recovery steam generator or at the outlet of the heat recovery steam generator in order to increase carbon dioxide concentration in the fuel gas and extract carbon dioxide in the carbon dioxide extraction unit. The heat recovery steam generator is made to be capable to recover fuel gas high-temperature heat and the boiler is made to generate high-pressure steam, necessary to extract and compress carbon dioxide. The fuel gas processing unit consists of a gas turbine, boiler to burn fuel gas from the gas turbine and carbon dioxide extraction unit, made to be capable to extract carbon dioxide after its concentration in the fuel gas, outgoing from the boiler, is increased, wherein the boiler is made to be capable to generate high-pressure steam, necessary to extract and compress carbon dioxide.

The disadvantage is a modest efficiency.

The combined cycle gas turbine plant is known (patent RU J °2542621, IPC F01K21/04, published on 20 Feb. 2015), which consists of a gas turbine unit, connected through an exhaust duct with a heat recovery steam generator with built-in interconnected heating surfaces of an economizer, evaporator and superheater, which is connected with a high-pressure steam turbine through a steam line. A boiler-condenser is connected, by a water pipeline through a first pump, with a heat recovery steam generator economizer, whereas the heat recovery steam generator has a gas duct to remove gases into a chimney. Low-pressure steam turbine is connected, by a steam line through a regenerative heat exchanger, with a condenser, which is connected with the regenerative heat exchanger by a water pipeline through a second pump. The high-pressure steam turbine is coupled through a shaft train with the low-pressure steam turbine, which is connected with a generator. The high-pressure steam turbine is connected through the steam line with the boiler-condenser which is connected with the first pump through the water pipeline. The second superheater built-in into the heat recovery steam generator is connected with the low-pressure steam turbine and condenser-boiler, which is connected with the second economizer, built-in into the heat recovery steam generator, whereas that economizer is connected with the regenerative heat exchanger through the water pipeline.

This invention allows raising electrical efficiency by increasing second working medium steam temperature at the low-pressure steam turbine inlet and decreasing heat recovery steam generator exhaust gases temperature, however such plant manufacturing complexity is a disadvantage.

A heat recovery steam generator is known (patent RU jV< >2562281, IPC F23J15/04, B01D53/14, published on 10 Sep. 2015), which is a part of a combined cycle power plant, comprising a gas turbine unit, operating on fossil fuel, heat recovery steam generator, connected to a gas turbine exhaust gas duct, a steam turbine, driven by a steam from the heat recovery steam generator, at least one generator, driven by the gas turbine and steam turbine through a shaft train, and carbon dioxide extraction unit, connected to the gas turbine unit from the exhaust gas side downstream the gas flow.

The heat recovery steam generator narrow application scope is a disadvantage.

A condensate recovery system is known (patent GB 0803698, F16T1/48, F17D5/00, F1705/06, dated 28 Feb. 2008). A condensate recovery system comprises a plurality of drain lines for draining condensate from an associated steam plant. Each drain line incorporates a steam trap and feeds into a common condensate return line running between the drain lines and a condensate receiver tank. The system further comprises an acoustic sensor positioned along the common condensate return line, upstream of the receiver tank, for providing an acoustic output indicative of the collective steam loss through steam traps upstream of the sensor The disadvantage is underperforming heat recovery method. Furthermore, most of the known solutions' shortfall is P-V diagram "rounding" for serial units, leading to the cycle thermodynamic efficiency decrease.

The above mentioned main factor expresses difference between the real and ideal Stirling cycle, being one of the heat recovery cycles, which efficiency approaches Carnot cycle. The main reason for "rounding" is continuous piston movement nature in contrast to intermittent movement for an ideal case. Another reason is clearance volume, that is the part of the common pressure side, which is not expelled by either of the pistons while engine works. In addition, when engine rotation rate increases, the negative effects occur, such as hydraulic resistance and working body compression and expansion processes non-isothermality. Attempts to increase channels flow sections and heat exchanging surfaces' areas face clearance volume increase. Another weakness is existing regenerating units' low efficiency, leading to insufficient cooling and heating of a working body at its expelling into cold or hot pressure side respectively, which, in case of compression, leads to raising portion of heat, removed in ambient environment, and subsequent requirement to arrange powerful and bulky cooling systems. The task of sealing engine's working space remains challenging given light high-fluid gases used as working bodies. Moreover, temperature equalization between a hot and cold area due to relatively solid heat exchanging engine parts and minimum distances additionally lowers real unit efficiency.

SUMMARY

The objective of the proposed solution is developing effective method of a working body heating with an option to recover processed steam (processed working body) heat with increased efficiency as well as embodiments of a boiler with recovery capacity to implement the method.

The objective is achieved using the boiler operation method, including working body heating and removal for its further utilization.

A working body is heated in the boiler, consisting of at least two chambers (item 3), from the heat of at least one heating medium; with the use of at least one of the boilers heat exchanger (item 8), (item 10), (item 16), the heating medium temperature difference with respect to the working body temperature in the chambers (item 3) is achieved by feeding more heated heating medium to the chambers (item 3), containing more heated working body and respectively less heated heating medium is fed into the chambers (item 3), containing less heated working body; once heated, working body is removed from the chamber (item 3) for its further utilization through at least one channel (item 17) or valve (item 4).

Preferably heating medium temperature change with respect to the single unit chamber (item 3), containing working body, being heated, is achieved by directing heating medium flow through valves (item 18) or (item 23).

Preferably heating medium temperature change with respect to the working body in the single unit chamber (item 3) is achieved by transferring the working body between the chambers (item 3) using valves (item 4).

Preferably heating medium temperature change with respect to the single unit chamber (item 3), containing working body, being heated, is achieved by redirecting heating medium flow by changing position of at least one heating medium supply channel, which is made movable and has its own drive.

Preferably heating medium temperature change with respect to the single unit chamber (item 3), containing working body, being heated, is achieved by changing the chambers (item 3) position, wherein the chamber is made movable and has its own drive.

Preferably one of the chambers (item 3) is periodically sealed, the chambers (item 3) are connected with each other by at least one valve (item 4), used to periodically transfer the working body from one chamber (item 3) into another one (item 3).

Preferably heat exchanger (item 8) is used to supply heat from the processed working body being in steam phase.

Preferably heat exchanger (item 10) is used to supply heat from the processed working body being in liquid phase.

Preferably heat exchanger (item 16) is used to supply heat from an external source.

Preferably the number of the heating mediums, heating the working body in one of the chambers (item 3) through at least one of the heat exchangers (item 8, 9, 16) is less than the number of heating mediums, used in the boiler, depending on the selected operation mode and boiler design.

Preferably at least one of the chambers (item 3) contains a heat exchanger (item 15) to remove heat from the working body.

Preferably the chambers (item 3), having the channel (item 19 or 8) connected, contain a heat exchanger (item 15) to remove heat from the working body.

Preferably at least one of the chambers (item 3), having no heat exchanger (item 15), is filled with the working body in liquid phase through the channel (item 19) in order to cool down the working body after it has been used.

Preferably the liquid phase working body is returned through the channel (item 19) wherein the channel (item 19) should be capable to be used for heat removal.

Preferably the liquid phase working body is returned to the boiler through the channel (item 19) after it has been used, and is further transferred through the heat exchanger (item 10) through at least one of the chambers (item 3).

Preferably at least one of the chambers (item 3) is equipped with a discharge channel (item 17) to remove the working body for further use.

Preferably the working body is removed from the chamber (item 3) into a common chamber (item 14), where the working body is heated by the heat of at least one heating medium, fed through at least one of the heat exchangers (item 8, 16), the working body is removed from the chamber (item 14) for its further use through the discharge channel (item 17).

Preferably at least one of the heating mediums, going through the common chamber (item 14) through at least one of the heat exchangers (item 8, 16), additionally goes through at least one of the chambers (item 3) through at least one of the heat exchangers (item 8, 16).

Preferably at least one of the chambers (item 3) has inlet channel (item 19) used to fill it with the working body, in addition, heat removal through the heat exchanger (item 15) is arranged in the chamber (item 3).

Preferably at least one of the chambers (item 3) is filled with the working body through the discharge channels of at least one of the heat exchangers (item 8, 10).

Preferably the chamber (item 3) is filled with the working body from the chamber (item 13), which is common for several chambers (item 3) and contain the heat exchanger (item 15) to remove heat from the working body.

Preferably at least one of the chambers (item 3), containing the heat exchanger to remove heat from the working body after it has been used, is then filled with the working body through the channel (item 19) which in its turn removes the working body from the discharge channels through at least one of the heat exchangers (item 8, 10), laid through at least one of the chambers (item 3).

Preferably the boiler is installed in the steam power plant closed circuit, the working body removed for its further utilization through the channel (item 17), is, after it has been used, again fed into the boiler through the channel (item 19).

Preferably the chambers (item 3) or (item 3 and 14) are positioned one above another and when they are connected the liquid phase working body is removed into the downstream chamber (item 3, 14) under the gravity action.

Preferably the chambers (item 3 and 14) are randomly positioned and when they are connected the working body liquid phase is partially or wholly transferred from the chamber (item 3 or 14) with a transfer pump.

Preferably the processed working body liquid phase is collected with at least one condensate collector (item 11) and then transferred through at least one of the heat exchangers (item 10) for the working body heating in the chambers (item 3) or chambers (item 3 and 14).

Preferably the processed working body liquid phase is transferred from the condensate collector (item 11) through the heat exchanger (item 10) using the pump (item 12).

Preferably the processed working body liquid phase is transferred from the condensate collector (item 11) through the heat exchanger (item 10) due to inclination thereof.

Preferably processed working body discharge from the heat exchanger (item 8, 10) channels is arranged into one of the chambers (item 3, 13) whereas their interiors are under pressure allowing to decrease the processed working body condensation specific heat and increase working body dew point temperature.

Preferably the boiler is partly thermally isolated.

Preferably the boiler, being part of the steam power plant or heat generating plant, is cleaned from all other bodies save the working body.

Preferably, while the working body liquid phase is transferred from the chamber (item 3) into the chamber (item 3 or 14), it is heated by the working body steam phase heat when the working body steam phase replaces the working body liquid phase being transferred; the working body liquid phase is heated due to direct contact of those phases or through the heat exchanger wall.

The objective is also achieved using the steam power plant boiler comprising the casing (item 1), working body feeding channel (item 19), working body discharge channel (item 17) and heat exchangers to supply heating medium.

The boiler comprises of at least two chambers (item 3) made in the casing (item 1) by a baffle (item 2), the baffles (item 2) between the chambers (item 3) have at least one valve (item 4) installed to periodically transfer the working body from one chamber (item 3) into another (item 3), at least one of the chambers (item 3) has at least one heat exchanger (item 8, 10, 16) installed to heat the working body, at least one of the chambers (item 3) is equipped with a channel (item 17) to discharge the working body.

The objective is also achieved using the steam power plant boiler comprising the casing (item 1), working body feeding channel (item 19), working body discharge channel (item 17), heat exchangers to supply heating medium.

The boiler comprises the chambers (item 3), positioned in the casing (item 1) radially towards the common central point, the chambers (item 3) have at least one heat exchanger (item 8, 10, 16) to heat the working body, the heat exchangers are equipped with the valves (item 18, 23) allowing to supply more heated working medium to the chambers (item 3), containing more heated working body, and respectively supply less heated working medium to the chambers (item 3), containing less heated working body, at least one of the chambers (item 3) is equipped with the channel (item 17) to discharge the working body.

Preferably the chamber (item 3) has at least one channel to supply heating medium made movable to change heating medium temperature with respect to the single-unit chamber (item 3).

Preferably the chambers (item 3) are made movable to change heating medium temperature with respect to the single-unit chamber (item 3).

Preferably at least one of the chambers (item 3) contains the heat exchanger (item 15) to remove heat from the working body.

Preferably at least one of the chambers (item 3 or 13) has the channel (item 19) to fill in the working body.

Preferably the chamber (item 3) is connected with the chamber (item 14), being common for several chambers (item 3), in order to discharge the working body from the chamber (item 3).

Preferably the chamber (item 3) is connected with the chamber (item 13), being common for several chambers (item 3), in order to feed the working body into the chamber (item 3).

Preferably the boiler is installed in the closed circuit of a steam power plant or heat generating plant.

Preferably the chambers (item 3) are positioned one above another.

Preferably the boiler additionally contains a transfer pump to transfer the working body between the chambers (item 3), (item 3 and 14).

Preferably the boiler includes the condenser (item 11) with the heat exchanger (item 10) to remove condensate and heat the working body in the chambers (item 3) or chambers (item 3 and 14).

Preferably the boiler includes the condenser (item 11) with the pump (item 12) to feed in the working body liquid phase through the heat exchanger (item 10).

Preferably the boiler includes the condenser (item 11) with the inclined heat exchanger (item 10) to discharge the working body liquid phase.

Preferably the boiler is partially thermally isolated.

Preferably the chambers (item 3 or 13) have the heat exchanger (item 8, 10) discharge channels to fill in the working body.

The technical achievement of the proposed group of inventions is increasing processed working body heat recovery efficiency in the external heated units.

The proposed boiler operation method is disclosed in the proposed boiler operation modes description.

BRIEF DESCRIPTION OF THE DRAWINGS

The boiler unit with recovery option embodiments.

DETAILED DESCRIPTION OF THE PREFERRED EMBODIMENT

Figure 1:
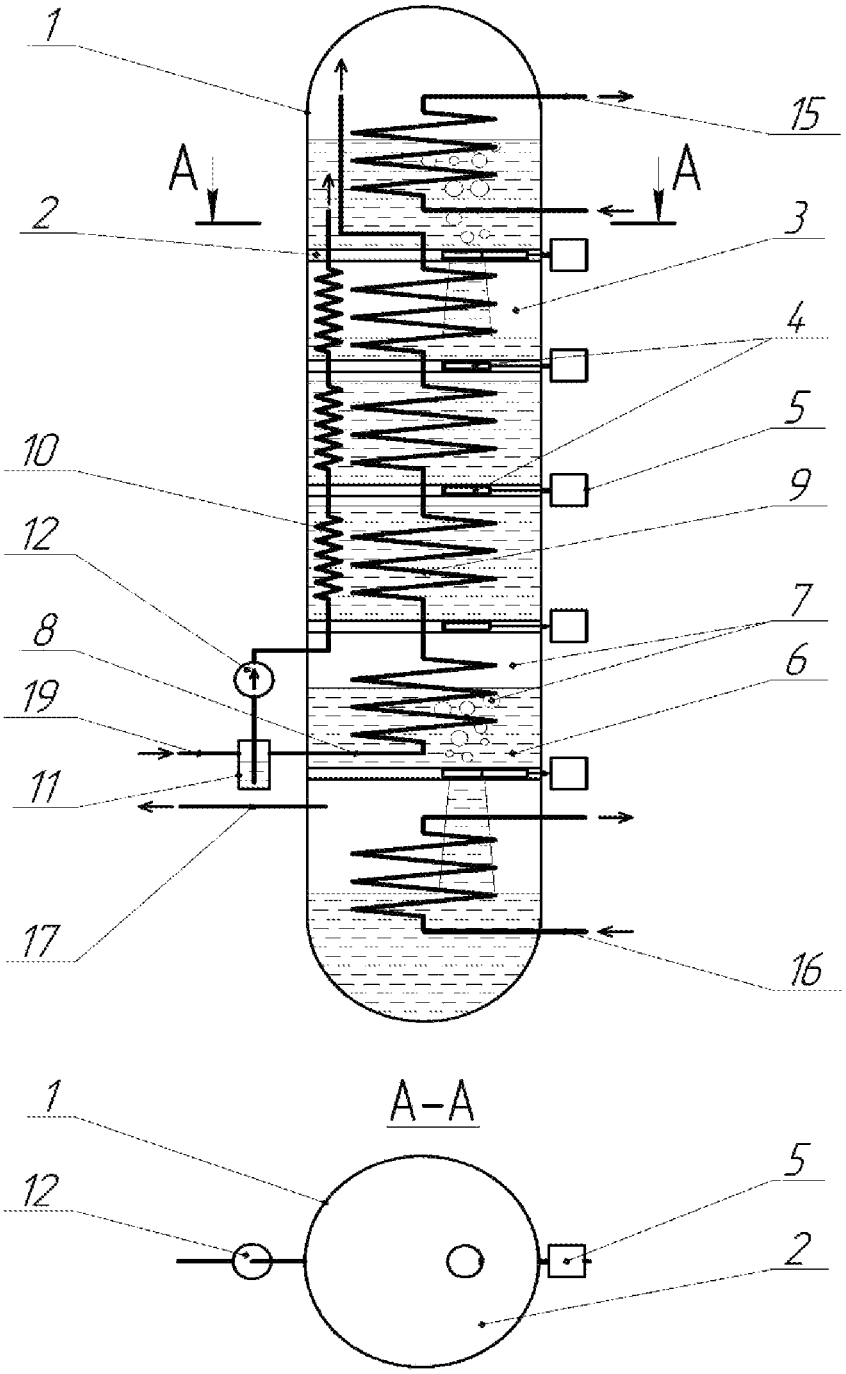
FIG. 1 demonstrates the boiler with heat recovery option to be used in a steam power plant, having the casing (item 1) in the shape of a closed cylinder divided by the baffles, side and cross-section view.

The FIG. 1 demonstrates the first boiler embodiment with heat recovery option, to be used in a steam power plant. The proposed embodiment specific feature is operation with the working bodies at the subcritical temperature and pressure parameters, characterized by the working body state when its liquid and steam phases are separated. The boiler comprises the casing (item 1) having the shape of the closed cylinder, where the baffles (item 2) make periodically sealed chambers (item 3). The baffles have valves (item 4) installed, opened and closed by solenoid drive (item 5).

Figure 2:
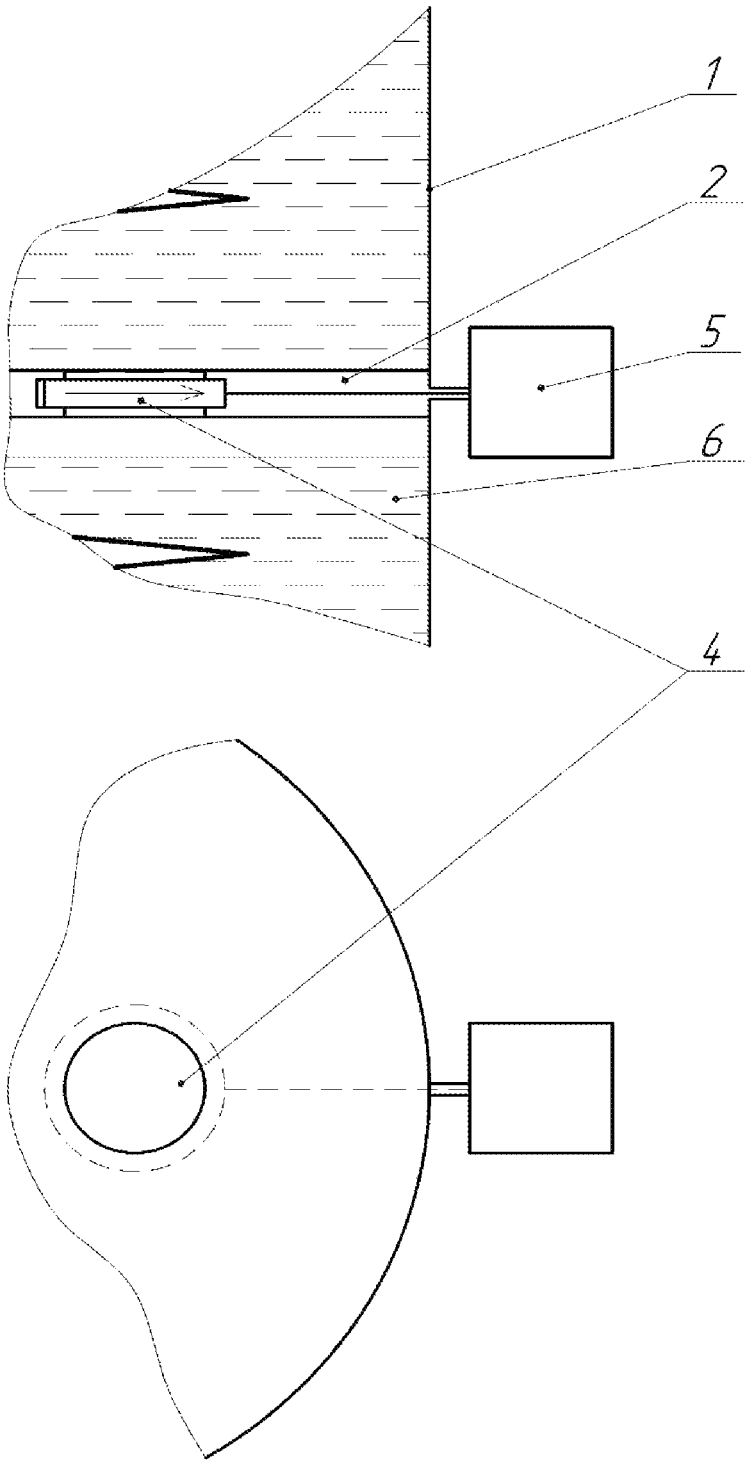
FIG. 2 demonstrates the valve (item 4) in the closed position, having similar design and operation mode for ail boiler embodiments, side cross-section and plan view.
Figure 3:
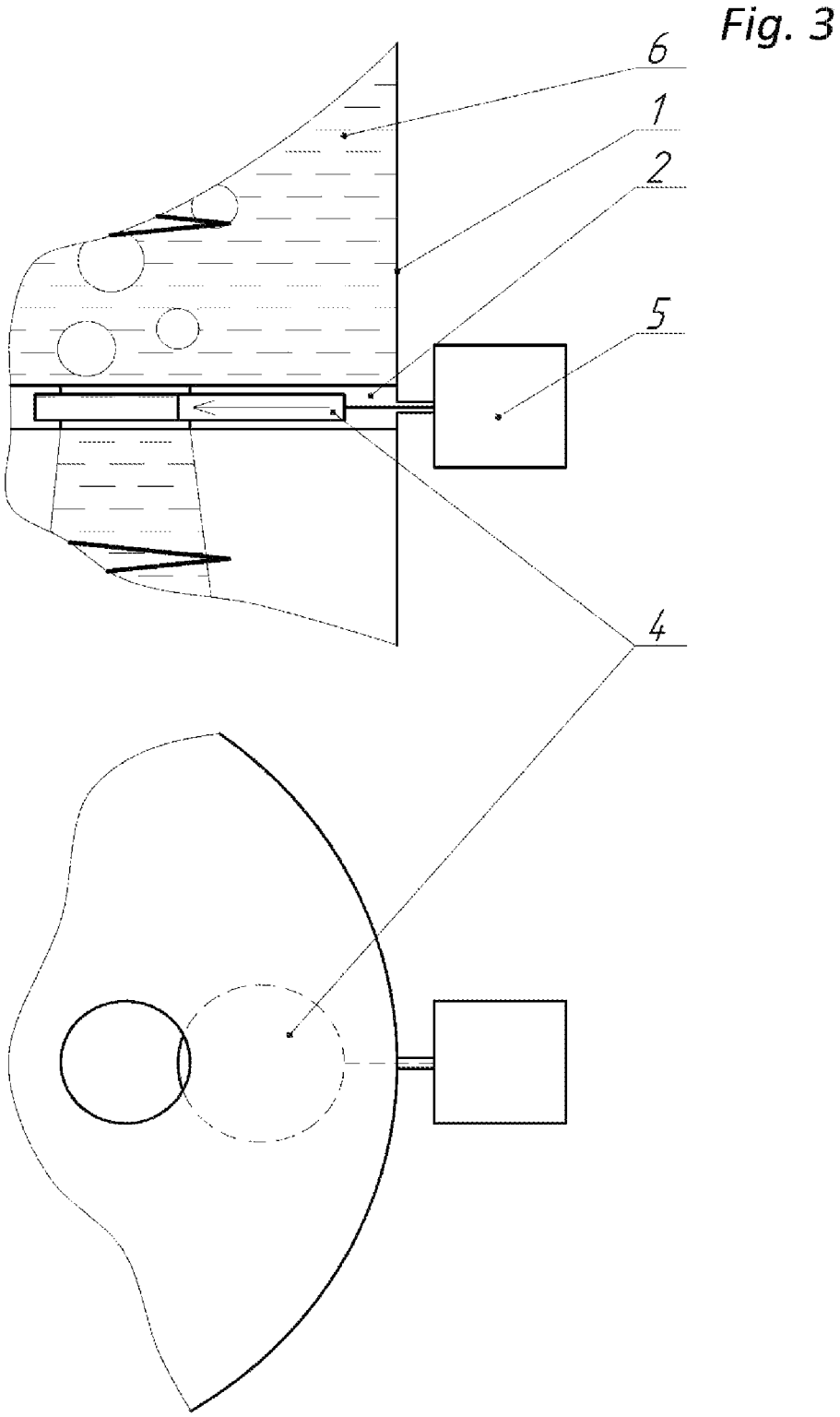
FIG. 3 demonstrates the valve (item 4) in the open position, having similar design and operation mode for all boiler embodiments, side cross-section and plan view.

The FIG. 2 demonstrates the valve (item 4) in a closed position and FIG. 3 demonstrates the same in an open position. The chambers (item 3) contain the working body (item 6) liquid phase, when the valves (item 4) are opened the pressure in the chambers being connected is equalized and the working body liquid phase inflows into the chamber (item 3) below under gravity action due to its higher density in comparison to the steam phase (item 7). When the boiler cylindrical casing (item 1) axis is positioned horizontally or otherwise a transfer pump (not shown) may be used to transfer the working body liquid phase between the connected chambers (item 3).

The chambers (item 3) are designed to heat the working body inside by recovering heat of the processed steam inflowing through the channel (item 19) and heat exchangers (item 8) equipped with the heat exchanging coils. The chambers are also crossed by the heat exchanger (item 10) channel, which is used to transfer the working body condensate, collected in the condensate collector (item 11) and fed by the pump (item 12). The variant of the heat exchanger (item 10) channel, ensuring the processed working body condensate self-drainage due to inclination thereof, is possible. Apart from the chambers (item 3), having heat exchangers (item 8), the boiler has the chamber (item 3) equipped with the cooling heat exchanger (item 15), served to discharge excess heat from the working body fed into the boiler using heat-transfer fluid. The chamber (item 3) is equipped with the heat exchanger (item 16) served to supply additional heat to the heated working body from an external source using a heat-transfer fluid. The heated working body in the steam phase is removed from the chamber (item 3) through the channel (item 17) for further use, for example, to convert steam heat energy into mechanical work. The boiler may have an operation mode when the chambers (item 3), located in the lower part of the unit, have the higher temperature processed working body supplied and, respectively, the chambers (item 3), located in the upper part of the unit, have the lower temperature working body supplied, hence there is a possibility to keep temperature gradient due to movement of the working body in the chambers (item 3) towards the flow of the processed working body, fed into the boiler. There is a possibility to decrease the working body condensation specific heat and increase dew point temperature through raising pressure in the chamber (item 3), equipped with the cooling heat exchanger (item 15), and another boiler interiors connected with the chamber (item 3) respectively. In such case heat capacity of the heated working body in the chambers (item 3), will naturally increase.

Figure 4:
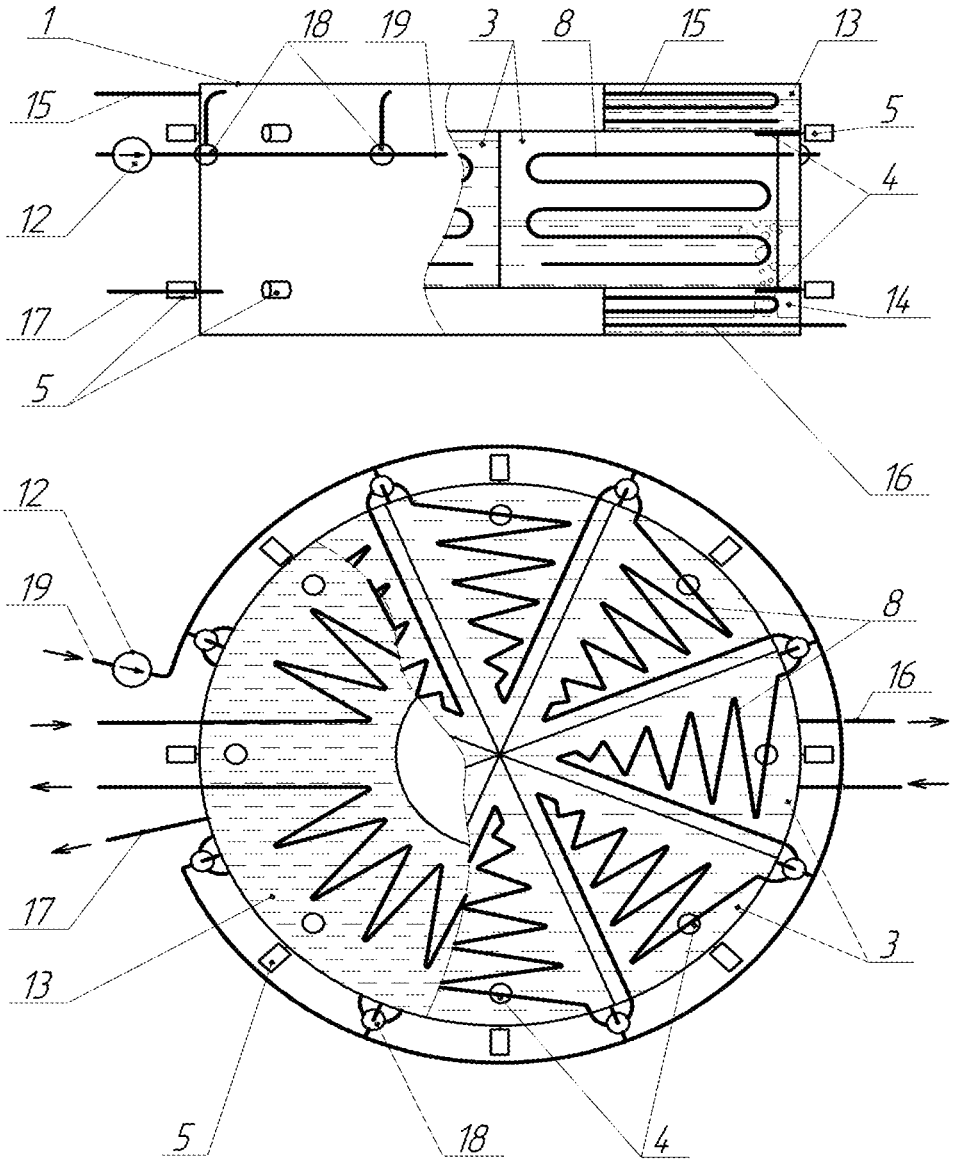
FIG. 4 demonstrates the boiler embodiment with heat recovery option to be used in a steam power plant, side and plan cross-section view.

The FIG. 4 demonstrates the second boiler embodiment with heat recovery option to be used in a steam power plant. The proposed embodiment specific feature is operation with the working bodies at the subcritical and supercritical temperature and pressure parameters. The boiler comprises the casing (item 1) in the shape of the cylinder consisting of several periodically sealed segmented chambers (item 3) positioned radially towards the common central point. The chambers (item 3) contain the working body (item 6) liquid phase, however a steam layer (item 7) may also present. The chambers (item 3) are designed to heat the working body inside by recovering heat of the processed steam, inflowing through the channel (item 19) and heat exchangers (item 8). The unit has common chamber (item 14) equipped with the heating heat exchanger (item 16) and channel (item 17) to discharge the working body. Each of the chambers (item 3) is connected with the chamber (item 14) through the valve (item 4), whereas their design and operation mode are similar to the unit embodiment 1, at valve (item 4) opening the working body transfers from the chamber (item 3) into the chamber (item 14) as per the principles, described in the first boiler embodiment. The common chamber (item 13) is equipped with the cooling heat exchanger (item 15) served to discharge excess heat from the working body, inflowing into the boiler, using heat-transfer fluid. The working body is transferred from the common chamber (item 13) into the chambers (item 3) through the valve (item 4) according to the similar principles of the working body transferring from the chamber (item 3) into the chamber (item 14). The working body is fed into the chamber (item 13) previously cooled in the heat exchangers (item 8) flowing consequently through the chambers (item 3). The valves (item 18) direct the flow of the processed working body, fed into the inlet channel (item 19) and flowing through the chambers (item 3) and further into the common chamber (item 13). The valves (item 18) are equipped with solenoid drive (not shown) and are made three-position: first position—the valve is open to transfer the working body from the channel (item 19) into the heat exchanger (item 8), whereas the channel (item 19) behind the valve is closed and there is no connection with the chamber (item 13). In the second position the valve is open to transfer the working body from the heat exchanger (item 8) into the heat exchanger (item 8), whereas there is no connection between the channel (item 19) and the common chamber (item 13). In the third position the valve is open to transfer the working body from the heat exchanger (item 8) into the common chamber (item 13), whereas the next heat exchanger (item 8) is closed and there is no connection with the channel (item 19). The valves (item 18) direct the processed working body flow and the entry and exit positions into the heat exchangers (item 8) or other chambers (item 3). This specific feature along with the chambers (item 3) filling and draining moment helps to implement the boiler operation mode when the chambers (item 3), containing most heated working body, are fed with the most heated processed working body and the chambers (item 3), containing least heated working body are fed with the less heated working body. Employing the above described heat exchange organization principle, the unit may use another heating medium, different from the processed working body, full or partial parallel usage of several heat exchangers, interfacing with the working body in the chambers (item 3), is also possible. In case of the boiler embodiment without the common chamber (item 13) the working body may be fed through the feeding channel (item 17), proprietary for each of the chambers (item 3), in such case each of the chambers (item 3) is equipped with its own cooling heat exchanger (item 15) to discharge excess heat from the cooled working body in the chamber (item 3) being filled in. Similar to the boiler embodiment without the common chamber (item 13) it is possible to have the boiler without the common chamber (item 14). In such case the heated working body will be discharged from each of the chambers (item 3) using their own channels (item 17). The unit is equipped with the feed pump (item 12) to supply the working body into the boiler.

Figure 5:
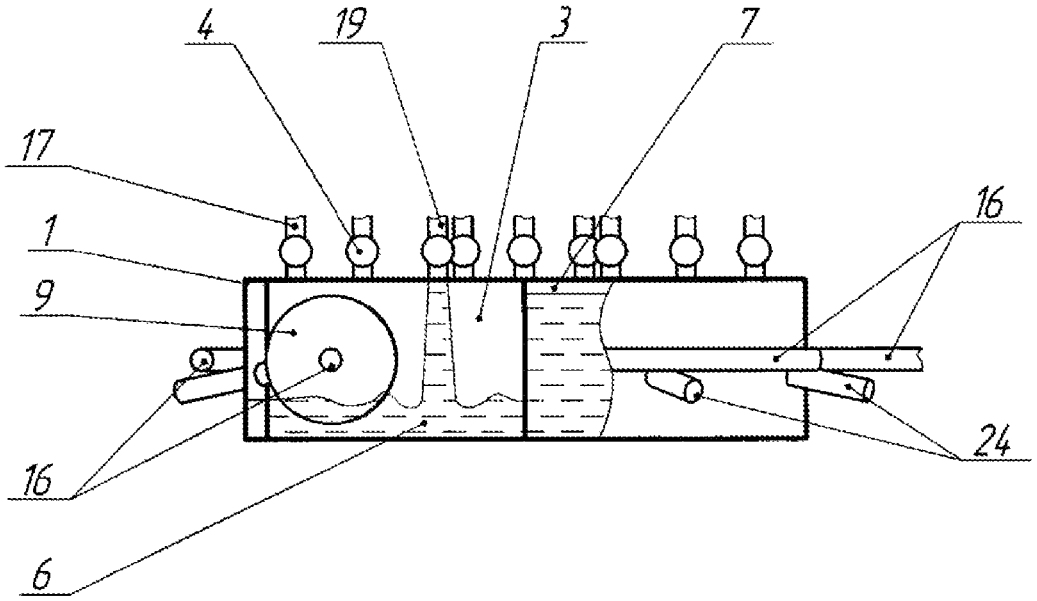
FIG. 5 demonstrates the boiler embodiment with heat recovery option to be used in a steam power plant, side and plan cross-section view.
Figure 5:
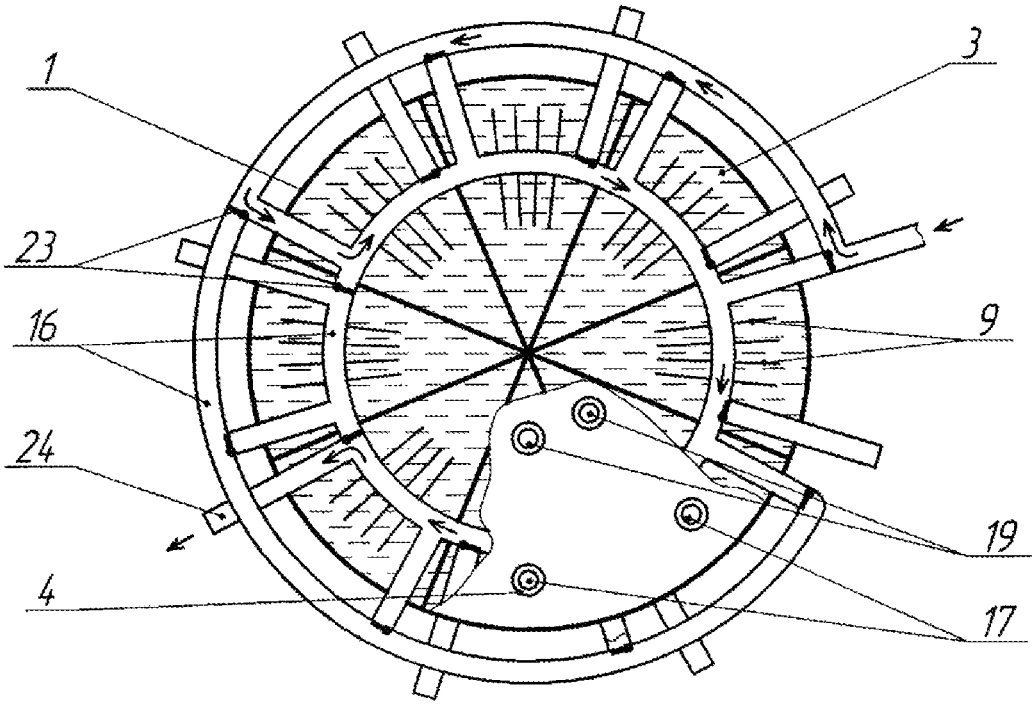

The FIG. 5 demonstrates the boiler embodiment with recovery option to be used in a steam power plant. The proposed embodiment specific feature is operation with the working bodies at the subcritical and supercritical temperature and pressure parameters. The boiler comprises the casing (item 1) in the shape of the cylinder, consisting of several periodically sealed segmented chambers (item 3), positioned radially towards the common central point. The chambers (item 3) contain the working body (item 6) liquid phase, however a steam layer (item 7) may also present. The chambers (item 3) are designed to heat the working body inside by the heat from the external heating medium, supplied through the heat exchanger (item 16). The valves (item 4) are designed to fill in and discharge the working body from the chambers (item 3), the valve (item 4) design and operation principle are similar to the embodiment 1. The heating medium gases flow in the heat exchanger (item 16) is directed by the flag-type valves (item 23), the valve's (item 23) flag position set direction for the heating medium movement. The gases are exhausted through the exhaust pipes (item 24) in sequences, depending on the flag-type valves (item 23) position. In combination with the chambers (item 3) filling and draining moment the boiler operation mode is achieved when the chambers (item 3), containing most heated working body, are fed with the most heated heating medium and the chambers (item 3), containing least heated working body are fed with the less heated heating medium. Employing the above described heat exchange organization principle, the unit may use another heating medium, different from for example processed working body, full or partial parallel usage of several heat exchangers, interfacing with the working body in the chambers (item 3), is also possible. Once the working body (item 6) is heated, it leaves the chamber (item 3) by the discharge channel (item 17) through the valve (item 4) for its further utilization, accordingly in case of filling the chamber (item 3) the working body (item 6), fed by the feed pump (item 12) (not shown on the FIG. 5), comes through the inlet channel (item 19) from the cooling heat exchanger (item 15). The arrows on the scheme show single-point heating medium and working body direction.

Figure 6:
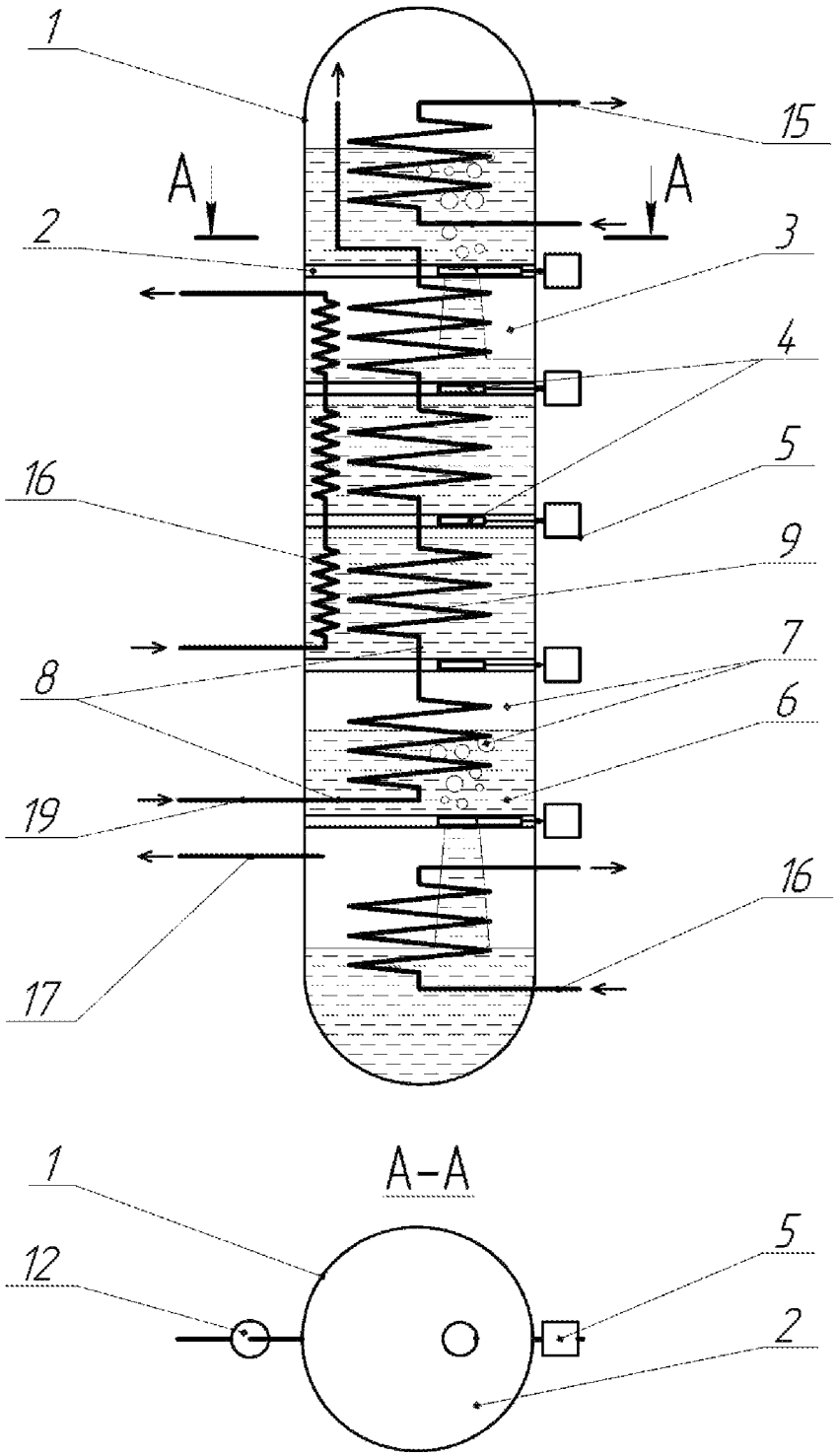
FIG. 6 demonstrates the boiler embodiment with heat recovery option to be used in a steam power plant, side and plan cross-section view.

The FIG. 6 demonstrates the boiler with heat recovery option to be used in a steam power plant. Its difference from the boiler embodiment, shown on the FIG. 1, lies in absence of the condensate collector (item 11) and feed pump (item 12), and the heat exchanger (item 16) for the heat-transfer fluid from the additional heat source is used instead of the heat exchanger (item 10) with the heat exchanging coils (item 9).

The following techniques are used for the boiler embodiments described above.

The boiler is partially thermally isolated to decrease heat losses and improve performance.

The boiler is equipped with the heat exchanger (item 15) to discharge heat and improve its performance.

The boiler is cylinder shaped to improve its performance.

The boiler is included into a steam power plant closed circuit to improve its performance.

The operated boiler is cleaned from any other particles, except the working body, to improve its performance.

Best Embodiment

All of the described boiler embodiments and their operation modes are best embodiments.

INDUSTRIAL APPLICABILITY

The proposed boiler operation mode employment allows using processed heat from the various heat plants. The boiler operation mode allows building highly cost-efficient external heated units.

What is claimed is:

1. A method for operation of a boiler, comprising:

heating a working body in the boiler, the boiler being made of at least two chambers, the heating being performed by at least one heating medium, the boiler comprising at least one heat exchanger;

when a first one of the at least two chambers contains the working body and a second one of the at least two chambers contains the working body, and the working body contained in the first one of the at least two chambers has a higher temperature than the working body contained in the second one of the at least two chambers, heating the working body in each of the first one and the second one of the at least two chambers by using the at least one heat exchanger to add a heating medium at a first temperature to the first one of the at least two chambers, and respectively add a heating medium at a second temperature to the second one of the at least two chambers, the second temperature being lower than the first temperature; and after the heating of the working body in each of the first one and the second one of the at least two chambers, removing the working body from each of the first one and the second one of the at least two chambers for further utilization through at least one channel or valve.

2. The method of claim 1, wherein the heating medium temperature change with respect to one of the at least two chambers containing the working body that is being heated is achieved by directing a heating medium flow through one or more valves.

3. The method of claim 1, wherein the heating medium temperature change with respect to the working body in the at least two chambers is achieved by transferring the working body between the at least two chambers using valves.

4. The method of claim 1, wherein one of the at least two chambers is periodically sealed, the at least two chambers being connected with each other by at least one valve through which the working body is transferred periodically from one of the at least two chambers into another one of the at least two chambers.

5. The method of claim 1, wherein the at least one heat exchanger is used to supply heat from a processed working body during a steam phase.

6. The method of claim 1, wherein the at least one heat exchanger is used to supply heat from an external source.

7. The method of claim 6, wherein a liquid phase working body, while being transferred from one of the at least two chambers into another one of the at least two chambers, is heated by a working body steam phase heat, wherein the working body steam phase flows into the one of the at least two chambers in place of the liquid phase working body being transferred;

the working body liquid phase being heated due to a direct contact to the working body steam phrase heat, or through a heat exchanger wall.

8. The method of claim 1, wherein a number of the heating mediums for heating the working body in one of the at least two chambers and using the at least one heat exchanger is less than a number of heating mediums used in the boiler.

9. The method of claim 1, wherein at least one of the at least two chambers contains a cooling heat exchanger for removing heat from the working body.

10. The method of claim 1, wherein the at least two chambers have a channel connected to them, and wherein at least one of the at least two chambers contains a cooling heat exchanger for removing heat from the working body.

11. The method of claim 1, further comprising:

returning a liquid phase working body to the boiler through a return channel after said liquid phase working body is used, and further feeding said liquid phase working body into at least one of the at least two chambers through the heat exchanger.

12. The method of claim 1, wherein at least one of the heating mediums, flowing through a common chamber, through at least one of the heat exchangers, flows in also afterwards through at least one of the chambers through at least one of the heat exchangers.

13. The method of claim 1, wherein at least one of the at least two chambers has an inlet channel to fill the at least one of the at least two chambers with a working body; the at least one of the at least two chambers configured such that the at least one heat exchanger removes heat therefrom.

14. The method of claim 1, wherein at least one of the at least two chambers is filled with a working body through at least one discharge channel of the at least one heat exchanger.

15. The method of claim 14, wherein at least one of the at least two chambers contains a cooling heat exchanger to remove heat from the working body after the working body has been used, and wherein the at least one of the at least two chambers is filled with the working body through a channel that transfers the working body from the at least one discharge channel of at least one exchanger interfacing with the at least one of the at least two chambers.

16. The method of claim 1, wherein the at least two chambers are positioned one above another, and when the chambers are connected, a liquid phase working body is transferred from an upstream chamber into a downstream chamber via gravity.

17. The method of claim 1, wherein the at least two chambers are positioned randomly, and when the chambers are connected, a liquid phase working body is partially or fully transferred from one of the at least two chambers into another of the at least two chambers using a transfer pump.

18. The method of claim 1, wherein the boiler is partly thermally isolated.

19. A steam power plant boiler, comprising:

a casing, a channel to feed in a working body, wherein the boiler comprises at least two chambers positioned in the casing radially towards a common central point, each of the at least two chambers being configured to contain the working body, at least one of the at least two chambers having at least one heat exchanger configured to supply a heating medium to heat a working body contained in the at least one of the at least two chambers, the at least one heat exchanger being equipped with at least one valve;

wherein, when the working body contained in a first one of the at least two chambers has a higher temperature than the working body contained in a second one of the chambers, the at least one valve is configured to supply a working medium at a first temperature to the first one of the at least two chambers, and respectively to supply a working medium at a second temperature to the second one of the at least two chambers, the second temperature being lower than the first temperature, at least one of the at least two chambers being equipped with a channel to discharge the working body.

20. The boiler of claim 19, wherein at least one of the at least two chambers has a cooling heat exchanger to remove heat from the working body located in the at least one of the at least two chambers.

* * * * *